United States Patent [19]

Keeffe et al.

[11] Patent Number: 4,888,517

[45] Date of Patent: Dec. 19, 1989

[54] DOUBLE-ENVELOPED LAMP HAVING A SHIELD SURROUNDING A LIGHT-SOURCE CAPSULE WITHIN A THICK-WALLED OUTER ENVELOPE

[75] Inventors: William M. Keeffe, Rockport, Mass.; Robert J. Karlotski, Weare, N.H.; Joseph S. Kulik, Allenstown, N.H.; Simone P. Bazin, Bedford, N.H.

[73] Assignee: GTE Products Corporation, Danvers, Mass.

[21] Appl. No.: 351,286

[22] Filed: May 5, 1989

Related U.S. Application Data

[63] Continuation of Ser. No. 90,983, Aug. 28, 1987, abandoned.

[51] Int. Cl.[4] ..... H01J 61/34; H01J 61/35; H01J 61/50; H01K 1/34

[52] U.S. Cl. ..... 313/25; 313/113; 313/573; 313/580; 313/635

[58] Field of Search ..... 313/25, 573, 580, 634, 313/113, 635

[56] References Cited

U.S. PATENT DOCUMENTS

| | | | |
|---|---|---|---|
| 4,342,937 | 8/1982 | Nagel | 313/113 |
| 4,345,178 | 8/1982 | Pappas | 313/113 |
| 4,459,506 | 7/1984 | Beck | 313/315 |
| 4,490,642 | 12/1984 | Dobrusskin et al. | 313/25 |
| 4,591,752 | 5/1986 | Thouret et al. | 313/25 |
| 4,721,876 | 1/1988 | White et al. | 313/25 |

*Primary Examiner*—Kenneth Wieder
*Attorney, Agent, or Firm*—Joseph S. Romanow

[57] ABSTRACT

A double-enveloped lamp having a shield surrounding a light-source capsule within a thick-walled outer envelope so that the lamp may be safely operated without necessity of a protective fixture. In the rare event of a burst of the light-source capsule, the shield absorbs and dissipates a portion of the burst energy sufficient to permit the thick-walled outer envelope to remain intact and contain shards and other internal parts within the lamp. In alternate embodiments, the shield may be reinforced, such as with a wire mesh, or the outer envelope may be reinforced, such as with a polymer coating, or both. A thin-walled capsule may be employed in combination with a shield and thick outer envelope. A lamp in accordance with the invention provides the unexpected benefits of improved luminous efficacy and better color rendering characteristics, since the presence of an optimally positioned shield causes the operation of the light-source capsule to be more nearly isothermal.

52 Claims, 12 Drawing Sheets

DOUBLE-ENVELOPED LAMP HAVING A SHIELD SURROUNDING A LIGHT-SOURCE CAPSULE WITHIN A THICK-WALLED OUTER ENVELOPE

CROSS REFERENCES TO RELATED APPLICATIONS

This is a continuation of co-pending application Ser. No. 090,983 filed on Aug. 28, 1987, now abandoned.

The following U.S. patent applications, all assigned to the assignee hereof, contain related subject matter: Ser. No. 047,226, filed May 7, 1987, now U.S. Pat. No. 4,791,334; Ser. No. 088,500, filed Aug. 17, 1987, now abandoned, continued from Ser. No. 650,938, filed Sept. 17, 1984, now abandoned; and Ser. No. 873,292, filed June 5, 1986, now U.S. Pat. No. 4,721,876, continued from Ser. No. 744,645, filed June 13, 1985, now abandoned, continued from Ser. No. 422,312, filed Sept. 23, 1982, now abandoned.

TECHNICAL FIELD

This invention relates to electric lamps and, more particularly, to double-enveloped lamps which may be safely operated without the need for enclosing the lamp within a protective fixture even in the event of a burst of the inner light-source capsule.

BACKGROUND ART

In a double-enveloped lamp having an inner light-source capsule, there is a small probability that the capsule will burst. If such an event occurs, the hot fragments of glass or shards and other capsule parts emanating from the burst capsule will be forcibly propelled against the outer envelope. If the outer envelope also shatters, there may be a safety hazard to persons or property in the immediate surroundings. In such a case, a "containment failure" of the lamp or outer envelope has occurred, since the outer envelope has failed to contain internal lamp parts within the lamp.

The cause of a lamp containment failure is unknown and unpredictable. There is no known way to eliminate the possibility of such a failure. Although its occurrence is rare, the consequences of a containment failure may be serious. Therefore, protective measures must be taken.

Lamp manufacturers regularly notify users of the possibility of a containment failure by means of warnings on packages and in descriptive materials. Suggested precautions are often included in specifications and operating instructions. One way to avoid the safety hazard is to operate the lamp within a protective fixture itself capable of containing such a failure. This method is more acceptable in commercial usage than in the consumer market, but it has disadvantages in either case. A protective fixture generally incurs additional cost, particularly if an existing fixture has to be modified or replaced. A protective lens reduces the light output of the lamp somewhat. It may be more difficult and expensive to replace a lamp in a protective fixture, and replacement of a lamp with a shattered outer envelope is itself a safety concern. There may be other technical or aesthetic drawbacks.

A preferred solution to the containment failure problem is clearly a lamp capable of self containment. To this end, there are several known techniques. One technique is to make the outer envelope stronger so that it will contain. In U.S. Pat. No. 4,598,225, issued July 1, 1986, to Gagnon, there is shown an outer envelope having a thick outer wall in combination with a light-source capsule with a thin inner wall. Another technique is that of shielding the outer envelope from the effects of a burst capsule. In U.S. Pat. No. 4,580,989, issued Apr. 8, 1986, to Fohl et al., a light-transmissive enclosure within the outer envelope surrounds the light-source capsule and shields the outer envelope. Also see Bechard et al., U.S. Pat. No. 4,281,274, issued July 28, 1981. Yet another technique is to reinforce the outer envelope or shield. In some cases, a light-transmissive coating may be applied to the outside surface of the outer envelope. See Ser. No. 088,500, filed Aug. 17, 1987 a continuation of Ser. No. 650,938, filed Sept. 17, 1984. In other cases, the shield may be reinforced by a wire mesh surrounding the outside surface thereof. For example, see Ser. No. 873,292, filed June 5, 1986, being a continuation of Ser. No. 744,645, filed June 13, 1985, which is a continuation of Ser. No. 422,312, filed Sept. 23, 1982.

These techniques are effective, particularly with lamps of lower wattages. However, as wattage increases, e.g., one hundred and seventy-five watts and higher, the energy released by a burst capsule is proportionately greater. The mentioned techniques cannot be relied on for certain containment, and improved techniques are still being sought.

It would be an advancement of the art if a lamp structure were provided wherein the outer envelope would reliably contain a burst of the inner light-source capsule even where the lamp wattage may be one-hundred and seventy-five watts or higher.

DISCLOSURE OF THE INVENTION

It is, therefore, an object of the invention to obviate the deficiencies in the prior art.

Another object of the invention is to provide a double-enveloped lamp which may be safely operated without a protective fixture.

Yet another object of the invention is to provide a novel structure for a double-enveloped lamp in which the outer envelope will contain a burst of the inner light-source capsule even in lamps having wattages of one hundred and seventy-five watts and higher.

Still another object of the invention is to provide a self-containing double-enveloped lamp which has improved luminous efficacy, color-rendering ability, and life.

A further object of the invention is to provide certain optimum values for wall thicknesses and cross-sectional radius ratios for the construction of self-containing double-enveloped lamps with improved performance characteristics.

These objects are accomplished, in one aspect of the invention, by provision of a double-enveloped electric lamp comprising a light-transmissive outer envelope enclosing an interior. The outer envelope has a minimum wall thickness which is greater than one millimeter.

The lamp further comprises a light-source capsule mounted within the outer envelope. The light-source capsule has an operating wattage. The light-source capsule is subject to burst on rare occasions.

Means for shielding the outer envelope by absorbing and dissipating a portion of the energy of a burst of the light-source capsule are included in the lamp. Such shielding means include a light-transmissive shield mounted within the outer envelope. The shield substantially surrounds the light-source capsule.

There are means within the lamp for providing electrical power from an external source to the light-source capsule and for mechanically completing the lamp.

A conceptual description of the invention is as follows. A lamp in accordance with the invention combines the shielding means and thick-walled outer envelope to achieve the self-containment feature. In alternate embodiments, the invention further combines reinforcing means for the shield, outer envelope, or both, in order to enhance the containment capability of a particular lamp structure. In other alternate embodiments, a thin-walled capsule may be employed in combination with the shield and thick-walled outer envelope and, possibly, with reinforcing means for the shield, outer envelope, or both, for enhanced containment capability. In still further embodiments, tempered glass may be used for the shield and/or outer envelope in accordance with the invention.

Lamps constructed in accordance with the invention will have the ability to contain a burst of the light-source capsule. Such lamps may be operated without the need for a protective fixture. These lamps will provide improved performance characteristics in comparison with their prior art counterparts.

BEST MODE FOR CARRYING OUT THE INVENTION

For a better understanding of the present invention, together with other and further objects, features, advantages, and capabilities thereof, reference is made to the following disclosure and appended claims taken in conjunction with the above described drawings.

As used herein, the term "light-source capsule" denotes: an arc tube of an arc discharge lamp, a tungsten-halogen incandescent capsule, or any light-emitting capsule having an internal operating pressure differing from the operating pressure within the outer envelope. When such a light-source capsule operates within an outer envelope, the possibility of a lamp containment failure exists.

The type of light-source capsule, e.g., metal-halide arc tube or tungsten-halogen capsule, is not critical to the pure containment function of the invention. From a strict containment viewpoint, only the presence of an inner capsule, capable of bursting and releasing a certain amount of energy, certain sized shards, and other capsule fragments, all with certain levels of heat, force, and/or momentum, is important. Accordingly, the invention describes and includes a generic capsule. Of course, in the description of any working example, the specific type and wattage of the light-source capsule should be identified in order to select related lamp parameters.

The terms "contain" and "containment" as used herein mean that the outer envelope of the lamp does not shatter as a result of a burst of the inner light-source capsule. When containment occurs, capsule shards and other internal lamp fragments remain within the lamp's outer envelope after a capsule burst.

The terms "efficacy" and "luminous efficacy" as used herein are a measure of the total luminous flux emitted by a light source, expressed in lumens per watt.

The term "higher-wattage" as employed herein with reference to a lamp (or lamp component) denotes a lamp (or component of a lamp) having a rated wattage of one hundred and seventy-five watts or greater.

The terms "thick" and "thin" as used herein with reference to wall thicknesses denote the following. A "thick" or "thick-walled" outer envelope means that the minimum wall thickness of the central portion of the envelope is greater than one millimeter. A "thin" or "thin-walled" light-source capsule means that the central portion or body of the capsule has a maximum wall thickness of less than one millimeter. In reflector-type lamps, a "thick-walled" outer envelope is intended to apply both to the reflectorized portion of the outer envelope and to the lens portion of the outer envelope.

Figure 1:
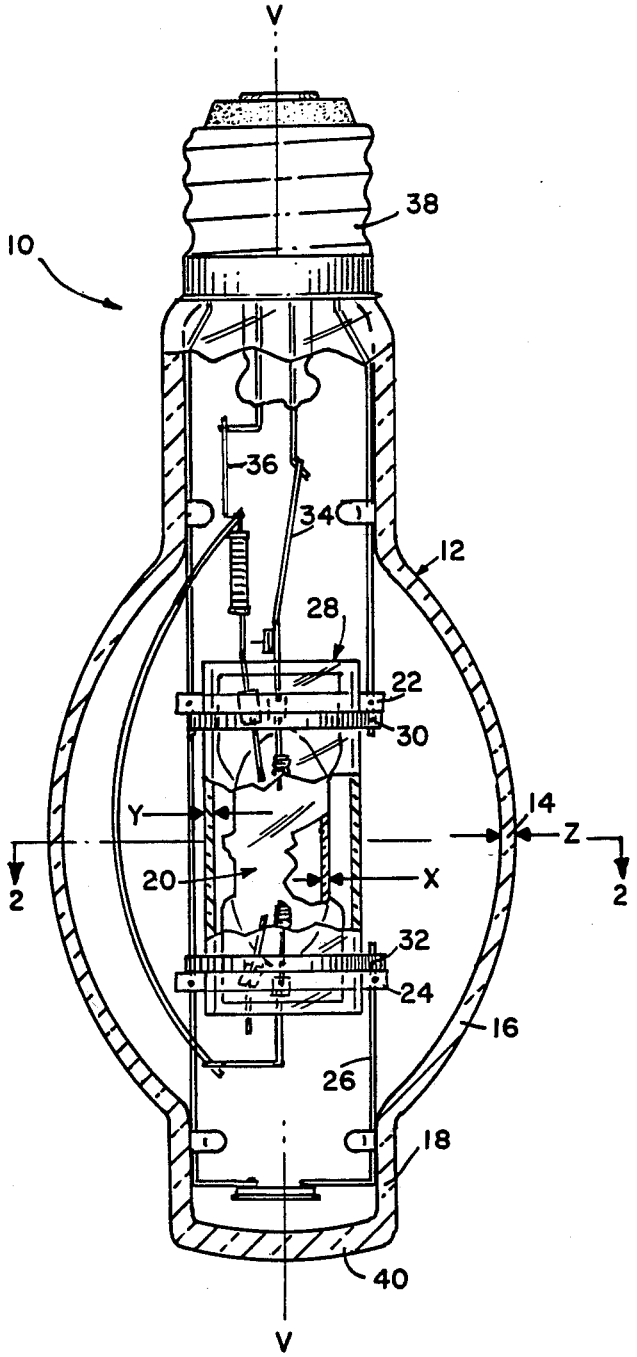
FIG. 1 is an elevational view of one embodiment of a lamp in accordance with the invention showing the light-source capsule, shield, and outer envelope partially in cross-section so that wall thicknesses may be observed.

FIG. 1 shows double-enveloped lamp 10 comprising light-transmissive outer envelope 12 enclosing an interior. In this embodiment, envelope 12 is formed from hard glass which has been blow-molded. The bulb portion of envelope 12 is shown substantially in cross-section so that relative wall thicknesses may be observed. The bulb portion of envelope 12 has a minimum wall thickness z at indicator 14. Although it may not be evident in the drawing, the wall thickness of envelope 12 is not uniform. This point is surprising. During the blow-molding process, the glass is blown into the bulbous shape shown in the figure. As the wall is stretched into the bulb shape, the wall thickness is reduced in proportion to the degree of stretching. Thus, the wall thickness at indicator 16 is thinner than at indicator 18, and it is minimum at indicator 14 where envelope 12 has been stretched to the greatest degree. From a containment viewpoint, the strength (or ability to contain) of any small area of envelope 12 is directly related to the wall thickness over that area. It appears that envelope 12 is weakest in the vicinity of indicator 14, i.e., in the middle region of the bulb portion of envelope 12. Laboratory observations of envelopes which have failed to contain corroborate this fact.

Since the weakest portion of envelope 12 surrounds capsule 20, the minimum wall thickness of the envelope is a critical factor for containment, an Achilles' heel. Because the surface area of a higher-wattage envelope is relatively large, the weight of the envelope increases substantially with only a slight increase in envelope wall thickness. Accordingly, there is a practical upper bound for the minimum wall thickness of envelope 12, lest the lamp be too heavy for a feasible commercial product.

In the present invention, minimum wall thickness z is greater than one millimeter. A preferred value for z is 0.040 inches (which is slightly greater than one millimeter). For reasons set forth above, this limitation is a significant departure from that of blow-molded envelopes in the prior art.

Light-source capsule 20 is mounted within outer envelope 12, such as by means of metal straps 22 and 24 which may be welded to metal frame 26. Capsule 20 has an operating wattage, e.g., four-hundred watts. As explained above, capsule 20 may burst on rare occasions for unknown reasons. In the embodiment of FIG. 1, capsule 20 is a double-ended metal-halide arc discharge tube formed from quartz glass.

Means for shielding envelope 12 from a burst of capsule 20 are mounted within envelope 20. The shielding means functions by absorbing and dissipating energy of a burst of capsule 20 such that the residual energy and forces, if any, which pass through the shield and reach envelope 12 may be contained by the outer envelope. In the embodiment of FIG. 1, the shielding means comprises light-transmissive right circular cylinder 28 which surrounds capsule 20 laterally. In other embodiments, shield 28 may be domed on one or both ends so that capsule 20 will be more fully enclosed. In the event of a burst of capsule 20, shield 28 may be shattered by the burst although, as will be explained, shield 28 will nevertheless absorb and dissipate a substantial portion of the energy and force of the burst.

Means are included within lamp 10 for providing electrical power from an external source to capsule 20 and for completing the lamp structurally. In FIG. 1, electrically conductive frame 26 is shown as a "floating" frame, meaning that the frame is electrically isolated from the lamp's circuit in order to reduce sodium migration out of capsule 20. Lead-in wires 34 and 36 are electrically coupled with the stem leads of base 38, e.g., a mogul type screw base, and provide power to the electrodes of capsule 20.

The central portion or body of capsule 20 has a wall thickness x; shield 28 has wall thickness y. When a burst of capsule 20 occurs, shield 28 absorbs or dissipates some (or all) of the energy of the burst. The extent of burst energy absorbed or dissipated by shield 28 is related to the ratio of y to x (and somewhat more weakly, to the ratio of the cross-sectional radii of the two components). For given radii, the percentage of burst energy absorbed or dissipated by shield 28 increases as y/x increases, i.e., as the mass of shield 28 increases with respect to the mass of the body of capsule 20.

Experience has shown that the open ends of shield 28 do not hinder containment. The relatively heavy press seals and lead-in wires of capsule 20 absorb substantial burst energy. Burst energy directed toward base 38 is absorbed by the lamp stem and base. Envelope 12 is blown in the base-up position. Consequently, the wall thickness in top 40 (positioned down) is greater than elsewhere in the envelope because of the gravitational effect on the molten glass. For these reasons, it is not necessary to include a domed end or ends for shield 28 for containment; the open cylinder is preferred for cost and ease of construction.

Lamp 10 employs a combination of shield 28 and thick-walled envelope 12 for containment. A major disadvantage of increasing the wall thickness of envelope 12 sufficient for containment without the shield is the increase in the weight of the envelope. A major disadvantage of increasing the wall thickness of shield 28 sufficient for containment without a thick outer envelope is the substantial reduction of luminous efficacy of the lamp (as well as the impractical effect of requiring the frame to be strengthened substantially in order to support the heavier shield). In the case of a Sylvania four-hundred watt Metalarc lamp, the wall thickness of a shield employed within a standard outer envelope must be greater than three millimeters for containment. This shield wall thickness causes a loss of luminous efficacy of approximately five to ten percent compared with the same Metalarc lamp with a standard envelope and no shield. As will be seen, an optimally positioned shield having a wall thickness of approximately 1.5 millimeters in accordance with the invention surprisingly improves the luminous efficacy and color-rendering ability of the lamp.

While neither shield 28 nor envelope 12 alone is adequate for containment in lamp 10, the combination of the shield and envelope is adequate for containment. Laboratory examples of four-hundred watt Sylvania Metalarc lamps were purposely induced to burst. In lamps having a shield with wall thickness of approximately one millimeter and a standard outer envelope, more than fifty percent failed to contain. In lamps having a thick outer envelope and no shield, slightly less than fifty percent failed to contain. In lamps having a shield with wall thickness of approximately 1.5 millimeters and a thick outer envelope, containment occurred one hundred percent of the time.

When a burst of capsule 20 occurs, shards and other capsule fragments are forcibly propelled against shield 28. In cases where the shield does not contain, the shield is shattered by the impact of the capsule shards. Shards, predominantly from the shield, are forcibly propelled against outer envelope 12, which does contain. A portion of the burst energy is consumed in the shattering of shield 28 and in imparting momentum to the shield shards. Since the affected area of the shield is generally larger than that of the capsule body, the burst energy per unit area of the shield is somewhat reduced. Another portion of burst energy is consumed in deformation of frame 26 and shield mounting straps 30 and 32. Most capsule shards bounce off the shield back toward the center of the capsule where they collide with other capsule shards going in the opposite direction. Another portion of burst energy is dissipated by these collisions. The affected area of the outer envelope is larger than that of the shield, so that the burst energy reaching the outer envelope is further reduced per unit area. Thus, the shield absorbs and dissipates a substantial portion of the burst energy even when it does not contain. The thick outer envelope has sufficient strength to contain the residual burst energy that passes through or is transferred through the shield.

In FIG. 1, lamp 10 has central axis V—V. As may be seen in the drawing, capsule 20 has a heat-reflecting coating, e.g., zirconium oxide, on the capsule's lower end in order to attain near isothermal operation of the capsule. Shield 28 assists in reflecting heat back to capsule 20. When the ratio of the inner radius of the shield to the outer radius of the capsule body is optimally selected, the surprising result is that the capsule operates hotter (which was expected) and more nearly isothermal (which was not expected).

Figure 2:
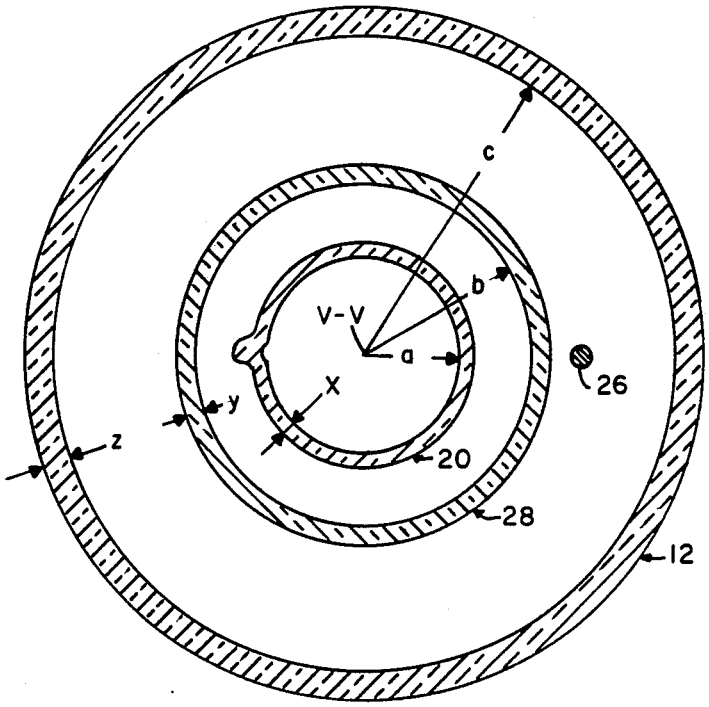
FIG. 2 is an enlarged cross-sectional view of lamp 10 along line 2—2 of FIG. 1, with parts removed for clarity, showing cross-sectional radii and wall thicknesses of the capsule body, shield, and outer envelope.

FIG. 2 is an enlarged cross-sectional view of lamp 10 along line 2—2 of FIG. 1, with parts removed for clarity. Line 2—2 passes through the center of capsule 20. Capsule 20, shield 28, and outer envelope 12 are shown as concentric walls about axis V—V. Radius a extends from axis V—V to the outer surface of capsule 20. Radius b extends from axis V—V to the inner surface of shield 28. Radius c extends from axis V—V to the inner surface of envelope 12. The corresponding diameters are twice the radius.

It is known that a light-transmissive sleeve surrounding a light-source capsule will conserve heat, and that the conservation is greatest when the ratio of the surface area of the capsule body to the area of the sleeve approaches unity for the ideal case of infinite cylinders. See C. S. Liu, Heat Conservation System for Arc Lamps, Journal of the Illuminating Engineering Society, Vol. 8, No. 4, July 1979. Equivalently in lamp 10, as the ratio a/b approaches unity, heat conservation is known to improve. Surprisingly, radiant heat redistribution follows a different scaling rule. When the additional constraint of uniform heat redistribution is imposed, an optimum radius ratio, a/b, is considerably less than that for heat conservation solely. In the case of the four-hundred watt Sylvania Metalarc lamp, the optimum radius ratio falls within the range of approximately 0.5 to 0.7. Laboratory experiments conducted thus far tend to show that this optimum range applies rather universally to higher-wattage lamps.

The term "optimum" radius ratio means that the best values of luminous efficacy and color uniformity are obtained when the ratio is within the prescribed range. With luminous efficacy, a maximum value is obtained within the optimum range. Regarding color uniformity, various measures of lamp color, such as the "chromaticity coordinates," maintain the same or similar values within the optimum range: from one lamp to the next; over the life of the lamp; and/or when the lamp is operated in various orientations with respect to the direction of gravity. In the case of the four-hundred watt Sylvania Metalarc lamp, optimum luminous efficacy and color uniformity are obtained with a light-source capsule having an outer radius of eleven millimeters and an inner shield radius of 17.5 millimeters (the ratio a/b being 0.63).

One would expect heat conservation to occur when shield 28 surrounds capsule 20. As may be seen in FIG. 1, the height of the cylindrical shield in this embodiment of the invention (height measured along axis V—V) is sufficient to surround the press seals laterally at the ends of capsule 20 as well as the body of the capsule. When the entire capsule is laterally surrounded by the shield, there is the additional benefit that the operation of the capsule is more nearly isothermal. It was anticipated that with shield 20, operating temperatures over the body of capsule 20 would increase uniformly. The surprising result is that the cold-spot temperature is elevated to a greater extend than the hot-spot temperature so that the distribution of operating temperatures over the body of the capsule is more nearly isothermal.

There are substantial benefits derived from the more nearly isothermal operation of capsule 20. Generally, most lamp characteristics, e.g., luminous efficacy, improve as the operation of the capsule approaches that of isothermal. For a fixed hot spot temperature, the cold spot is hotter than expected in lamp 10. This improves color rendition because more of the metal-halide additive is in the vapor state. For a given cold spot temperature, the hot spot is cooler than expected in lamp 10. Consequently, the free sodium and/or scandium in the additive will be less reactive with the quartz wall of the capsule in the vicinity of the hot spot. Because temperature differentials are reduced, thermal stresses within the capsule walls are also reduced.

Figure 3:
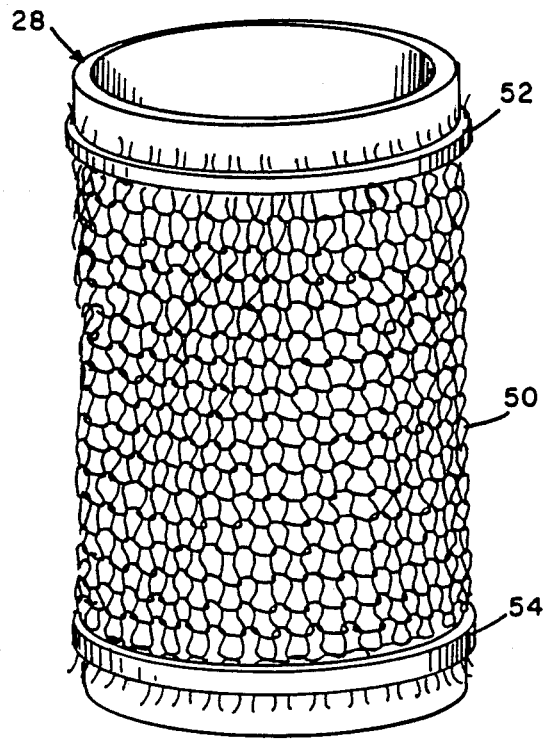
FIG. 3 is a pictorial view of an embodiment of a shield which may be employed in the lamp of FIG. 1, such shield including wire-mesh reinforcing means.

FIG. 3 is a pictorial view of shield 28 of lamp 10 wherein the shield includes reinforcing means, such as wire mesh 50. Mesh 50 may be mounted on shield 28 by means of metal straps 52 and 54, or it may be imbedded within the glass wall. In some embodiments, mesh 50 may be loosely knitted, as shown in the drawing, because of the knitted mesh's additional energy-absorbing capability over that of a rigid mesh. Stainless steel wire with a high chromium content is a preferred material for the construction of the mesh and mounting strap or straps because of its superior high-temperature properties, relatively low coefficient of thermal expansion, good resistance to oxidation and corrosion, and high tensile strength. An alternate material for the mesh may be glass or quartz thread, similarly woven or knitted, which has the advantage that its dielectric property will not encourage sodium migration from the capsule. High-temperature polymer filaments are also suitable materials for the mesh.

It is desirable that the mesh be as light-transmissive as possible so that there will be a minimal effect on the luminous efficacy of the lamp. The mesh size, i.e., the number of stitches per inch, and wire diameter should be selected such that the mesh will contain shards with mass large enough to be likely to cause a rupture of the outer envelope in the event of a burst of the light-source capsule. There is no requirement, however, that the mesh restrain all shards. The mesh, like the shield, performs the function of absorbing and dissipating burst energy sufficiently to permit the outer envelope to contain. Mesh size and wire diameter may be selected such that lamp efficacy is not unduly compromised.

Figure 4:
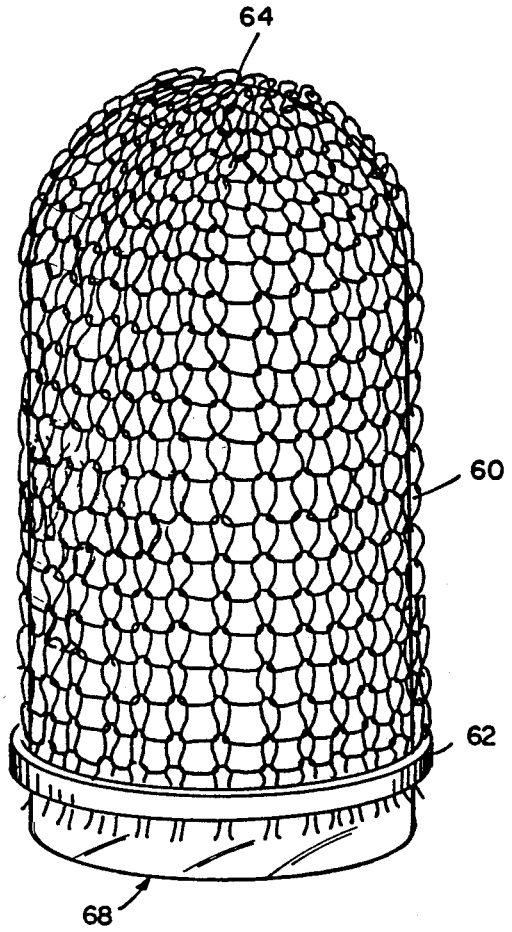
FIG. 4 is a pictorial view of an example of a shield which may be employed in accordance with the invention, such shield being domed on one end and including dome wire-mesh reinforcing means.

FIG. 4 shows another example of a shield which may be employed in accordance with the invention. In this embodiment, shield 68 is domed with domed reinforcing wire mesh 60 mounted on the shield by means of metal strap 62. This shield may be employed in combination with a single-ended light-source capsule, or with a double-ended capsule provided an opening is made in domed top 64 for the lead-in wire or support.

In embodiments where a wire mesh is employed, there is the possibility of an electrical short circuit caused by contact of the wire mesh with both lead-in wires. Where this possibility is a concern, one or both lead-in wires may be insulated by means of a dielectric sleeve or coating. It may be desirable to prevent the wire mesh from contacting a single lead-in wire or any component of the electrical circuit so that sodium migration out of the light-source capsule will not be spurred by the presence of the mesh. A rectifying device, e.g., a diode, between the mesh and electrical circuit, may be included as an additional precaution.

Figure 5:
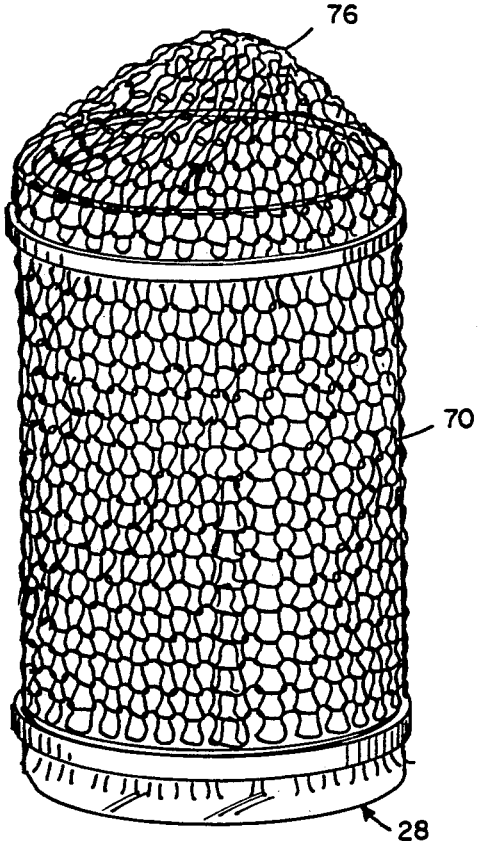
FIG. 5 is a pictorial view of another example of a shield which may be employed in accordance with the invention, such shield being open at both ends and including domed wire-mesh reinforcing means.

FIG. 5 shows another example of a shield and reinforcing mesh combination wherein shield 28 is a right circular cylinder open at both ends and wire mesh 70 is domed at end 76 thereof.

Figure 6:
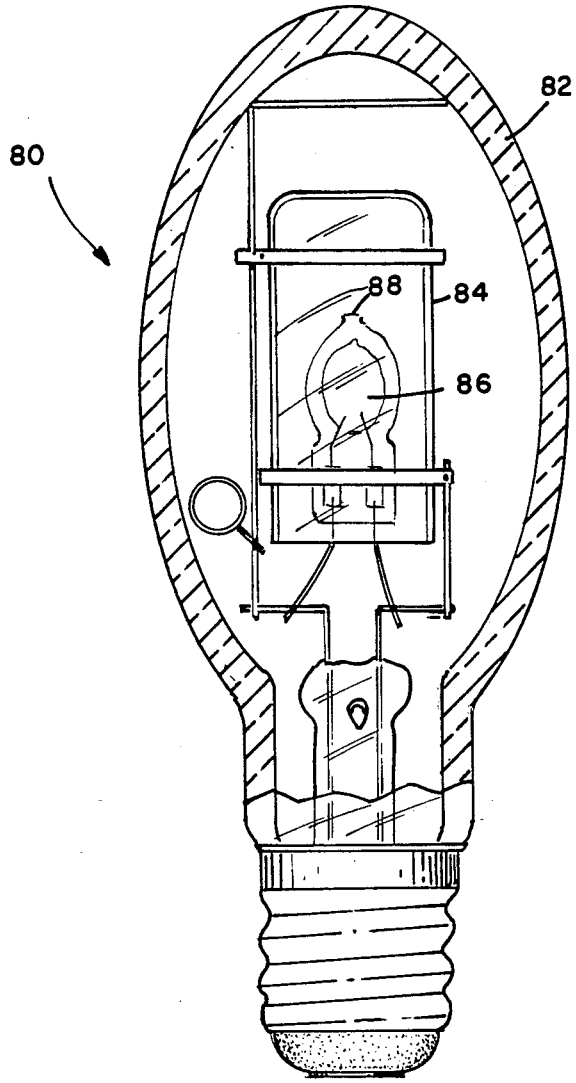
FIG. 6 is an elevational view of another embodiment of a lamp in accordance with the invention, such lamp having a single-ended metal-halide arc tube in combination with a shield and thick-walled outer envelope.

FIG. 6 is an elevational view of another embodiment of a lamp in accordance with the invention. Lamp 80 includes single-ended metal-halide arc tube 86 surrounded by domed shield 84 within thick-walled outer envelope 82. Because of the absence of any type of burst restraint, such as a press seal and lead-in wire, at top 88 of arc tube 86, shield 84 may be domed above top 88.

Figure 7:
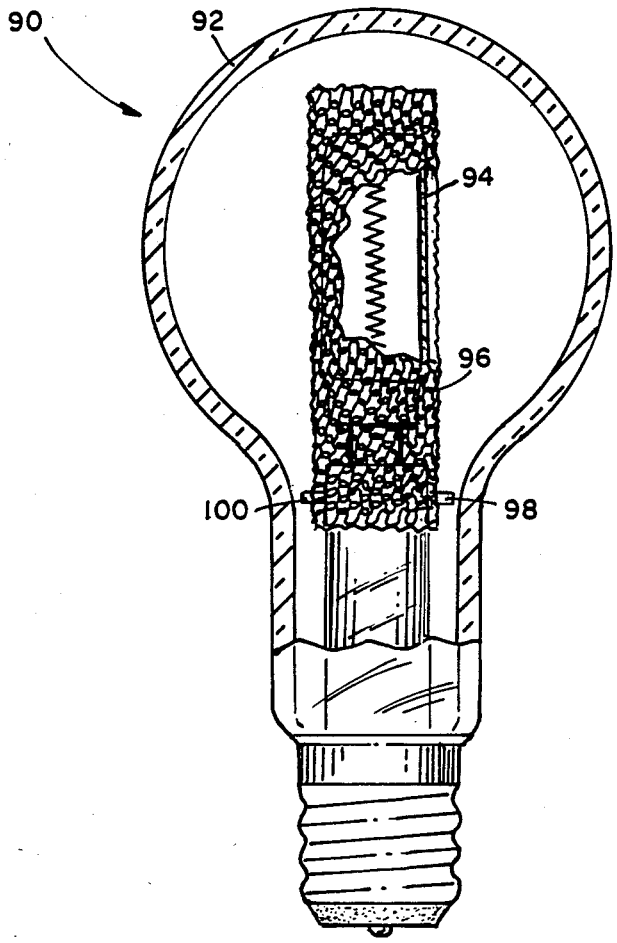
FIG. 7 is an elevational view of still another embodiment of a lamp in accordance with the invention, such lamp including a single-ended tungsten-halogen capsule, a shield comprising a wire mesh, and a thick-walled cuter envelope.

FIG. 7 is an elevational view of still another embodiment of a lamp in accordance with the invention. Lamp 90 underscores the point that a wire mesh itself can be shielding means in accordance with the invention, because the mesh absorbs and dissipates burst energy which, by definition, is the function of the shield. Lamp 90 includes single-ended tungsten-halogen light-source capsule 94 surrounded by wire-mesh shield 96 within thick-walled outer envelope 92. Shield 96 may be anchored to the lamp stem by anchoring pins 98 and 100. As this embodiment illustrates, there is no requirement that the shield be a closed or continuous surface. So long as mesh 96 absorbs and dissipates burst energy sufficiently for envelope 92 to contain, the "mesh" is a "shield" in accordance with the invention.

Figure 8:
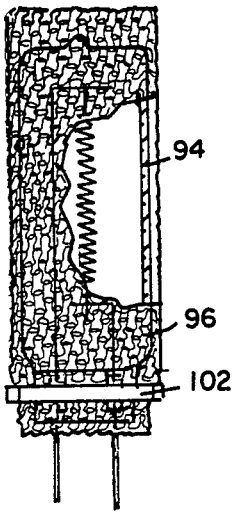
FIG. 8 is an elevational view of an alternate embodiment of a wire-mesh shield which may be employed in the lamp of FIG. 7, such shield being mounted on the press seal of the light-source capsule.
Figure 9:
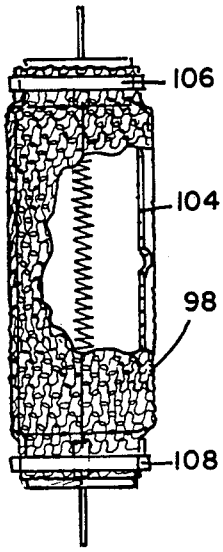
FIG. 9 is an elevational view of an embodiment of a double-ended tungsten-halogen light-source capsule and wire-mesh shield which may be employed in accordance with the invention.

FIGS. 8 and 9 illustrate other examples of wire-mesh shields surrounding single-ended and double-ended light-source capsules, either of which may be employed in combination with a thick-walled outer envelope in accordance with the invention. Mounting straps 102, 106, and 108 are suggested in the drawings. However, these mounting straps may not be necessary Shields 96 and 98 may be mounted on capsules 94 and 104, respectively, by means of elastic and frictional forces imparted by the mesh itself on the capsule.

Figure 10:
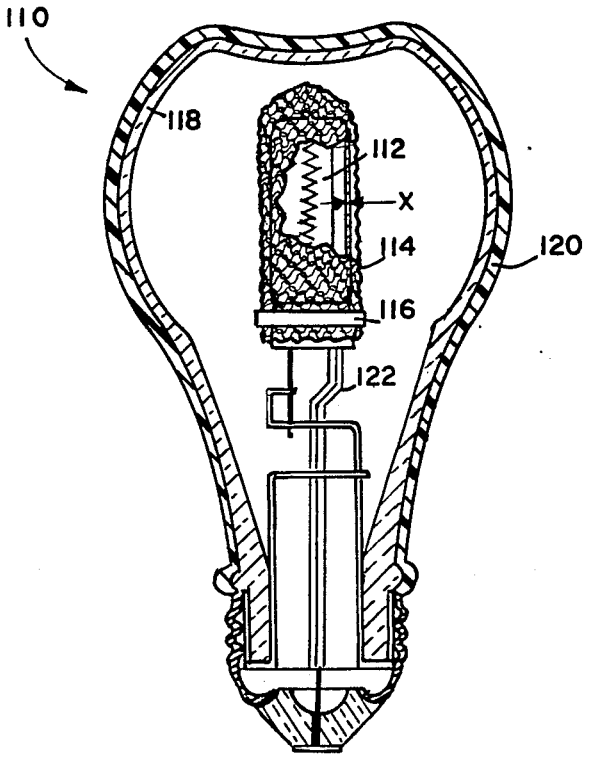
FIG. 10 is an elevational view of another alternate embodiment of a lamp in accordance with the invention in which the lamp includes a thin-walled light-source capsule, a shield comprising a wire mesh, a thick-walled pressed glass outer envelope, and a polymer coating as reinforcing means disposed on the outside surface of the outer envelope.

FIG. 10 is an elevational view of another embodiment of a lamp in accordance with the invention. Lamp 110 employs a thick outer envelope 118 formed from pressed glass. In lamp 110, light-source capsule 112 has a thin-walled body, i.e., wall thickness x of the body of capsule 112 is less than one millimeter. The use of a thin-walled capsule substantially reduces the burst containment requirements on cooperating lamp components. See U.S. Pat. No. 4,598,225, issued July 1, 1986, to Gagnon, wherein a tungsten-halogen lamp having a thick outer wall in combination with a light-source capsule having a thin inner wall (i.e., less than .9 millimeters) is disclosed.

In lamp 110, thin-walled capsule 112 is employed with wire-mesh shield 114 and thick-walled envelope 118. Shield 114 is mounted on capsule 112 by means of metal strap 116. Lead-in 122 is enclosed within a dielectric sleeve to prevent contact with wire-mesh 114. Lamp 110 may also have light-transmissive reinforcing means 120 disposed on the outside surface of outer envelope 118. Reinforcing means 120 may be a light-transmissive polymer coating, such as a teflon compound or perfluoroalkoxy resin, the latter being suggested in Ser. No. 088,500 filed Aug. 17, 1987, now abandoned, a continuation of Ser. No. 650,938, filed Sept. 17, 1984. The reinforcing coating may be applied to the inside of the outer envelope in other embodiments.

Figure 11:
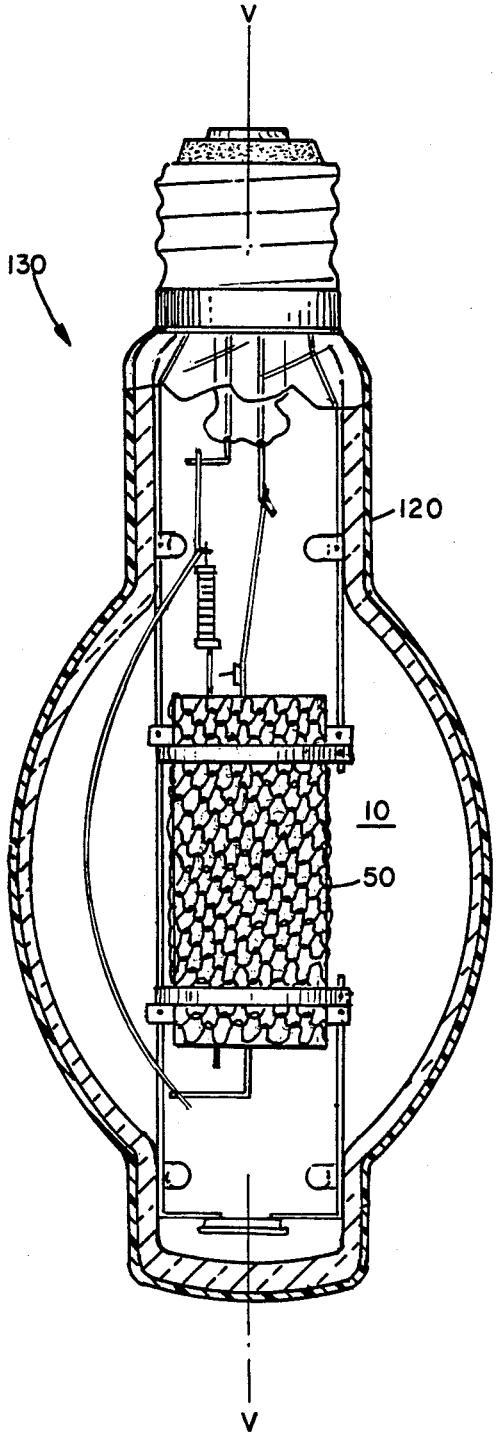
FIG. 11 is an elevational cross-sectional view of another embodiment of a lamp in accordance with the invention, wherein such lamp has a polymer coating on the outside of the outer envelope as reinforcing means for the outer envelope and a wire-mesh mounted on the shield as reinforcing means for the shield.

FIG. 11 is an elevational cross-sectional view of the lamp of FIG. 1 wherein lamp 10 employs wire-mesh reinforcing means 50 on shield 28 and light-transmissive reinforcing coating 120 on the exterior of outer envelope 12. As lamp 130 demonstrates, judicious choice of various reinforcing means in accordance with the invention will enable lamps with higher wattage to be safely operated without the necessity of a protective fixture.

Figure 12:
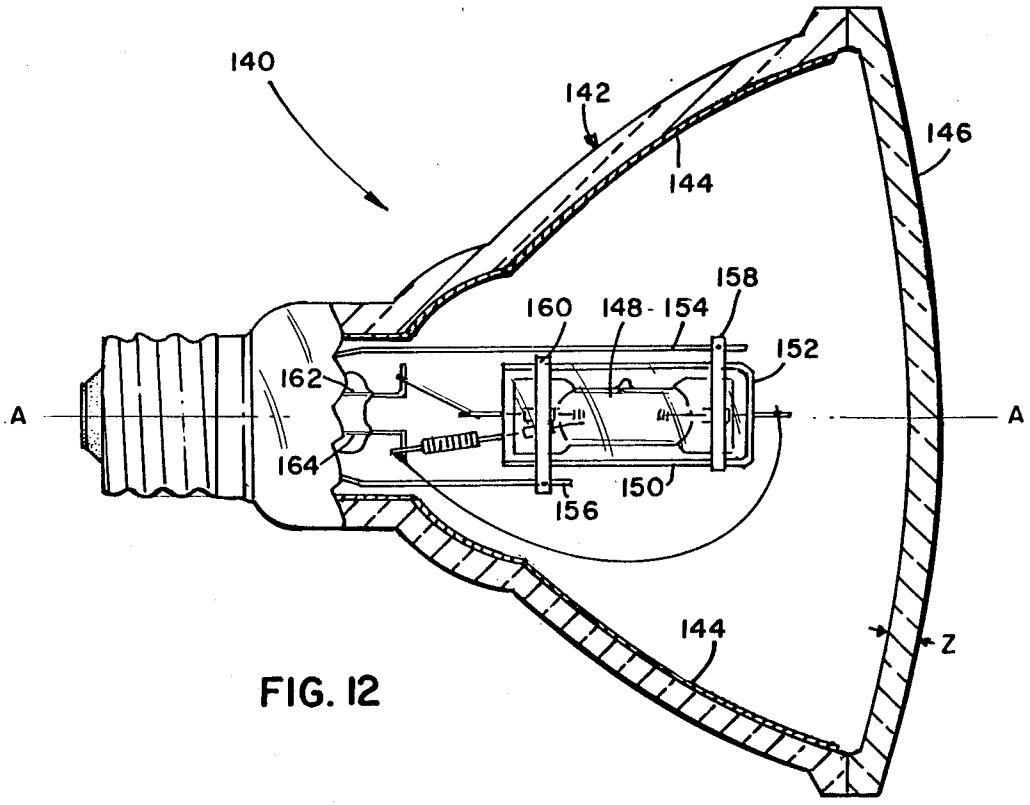
FIG. 12 is an elevational cross-sectional view of another embodiment of a lamp in accordance with the invention showing a reflector-type lamp, a double-ended arc tube, a domed shield, and a thick-walled pressed-glass outer envelope.

FIG. 12 is an elevational cross-sectional view of a reflector-type lamp in accordance with the invention. Lamp 140 has thick-walled outer envelope 142, which is pressed glass, having light-reflecting surface 144 disposed on the interior surface thereof. Light-transmissive lens 146 comprises a portion of outer envelope 142. Outer envelope 142 has minimum wall thickness z, which may occur in the reflecting portion of the outer envelope or in the lens portion of the outer envelope (as shown in the drawing). Minimum wall thickness z is greater than one millimeter in accordance with the invention. In this embodiment, light-source capsule 148 is a double-ended metal-halide arc tube mounted along central lamp axis A-A. Light-transmissive domed shield 150 surrounds capsule 148 laterally and about one end where dome 152 provides burst restraint for lens 146. Shield 150 may be mounted by means of metal straps 158 and 160 on frame wires 154 and 156, respectively. Frame wires 154 and 156 are electrically isolated from lead-in wires 162 and 164. When shield 150 is optimally positioned in accordance with the invention, lamp 140 will have improved efficacy and color rendering.

Figure 13:
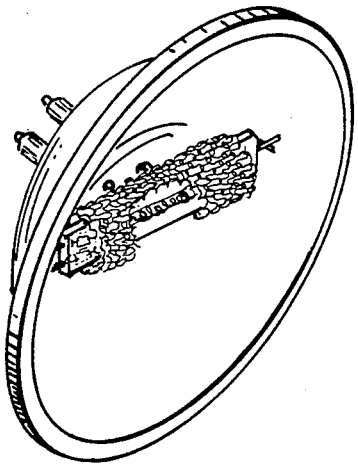
FIG. 13 is a pictorial view of an alternate embodiment of a reflector lamp in accordance with the invention, the lens being removed for clarity, showing a double-ended tungsten-halogen light-source capsule, a mesh shield surrounding the capsule, and a thick-walled pressed-glass outer envelope.

FIG. 13 is a pictorial view of an alternate embodiment of a reflector lamp in accordance with the invention. Reflector lamp 170 includes double-enveloped tungsten-halogen light-source capsule 172 mounted within thick-walled reflectorized outer envelope 174. Outer envelope 174 may be formed from pressed glass. Mesh shield 176 surrounds capsule 172. Shield 176 may be mounted on capsule 172 by means of elastic and frictional forces exerted by the mesh itself on the capsule or with of mounting straps about the press seals. In FIG. 13, the lens has been omitted for clarity. The minimum wall thickness of both the outer envelope and lens is greater than one millimeter in accordance with the teaching of the invention.

In any of the above-mentioned examples, the outer envelope or shield (when the shield is other than quartz)

may be strengthened by a suitable tempering process in which a high permanent stress is induced in the glass placing the outer surface in a high degree of compression. Use of tempered glass to enhance the containment capability of the outer envelope and/or shield is within the scope of the invention.

In many reflector lamps (as well as the example lamp of FIG. 10), the outer envelope is formed from pressed glass. In these lamps, the wall thickness of the outer envelope is generally greater than in lamps having blow-molded envelopes. Nevertheless, the containment failure problem may exist, particularly in higher-wattage lamps. As illustrated in FIGS. 12 and 13, the teachings of the present invention are intended to apply to pressed-glass envelopes as well as blow-molded envelopes, It is believed that the combination of a thick-walled outer envelope and enclosed shield is a substantial advancement of the lamp art irrespective of the lamp type or method of forming the outer envelope.

WORKING EXAMPLE

An improved Sylvania four-hundred watt Metalarc lamp has been designed in accordance with the invention. In the laboratory example, the metal-halide arc tube is formed from quartz glass having a body wall thickness of approximately one millimeter. The shield is a quartz (or vycor) right circular cylinder, open at both ends, with wall thickness of approximately 1.5 millimeters. The outer envelope is a blow-molded hard glass envelope, shaped substantially as shown in FIG. 1, having a minimum wall thickness of 0.040 inches (slightly greater than one millimeter). The outer envelope is hermetically sealed enclosing an atmosphere of nitrogen at 400 Torr cold pressure. A floating frame, as illustrated in FIG. 1, is employed. The arc tube has an outer radius of approximately 11 millimeters. The shield has an inner radius of approximately 17.5 millimeters. The outer envelope has an inner radius of approximately 58 millimeters. The ratio a/b is approximately 0.63.

In laboratory examples purposely induced to burst, containment occurred one hundred percent of the time. The luminous efficacy for the laboratory example with the shield is approximately nine lumens per watt higher than in a comparable lamp without the shield, measured after six thousand hours of life test. The color characteristics of the laboratory example are significantly improved.

While there have been shown what are at present considered to be the preferred embodiments of the invention, it will be apparent to those skilled in the art that various changes and modifications can be made herein without departing from the scope of the invention as defined in the appended claims.

We claim:

1. A higher-wattage double-enveloped electric lamp comprising:

(a) a light-transmissive outer envelope enclosing an interior, said outer envelope having a minimum wall thickness greater than one millimeter;

(b) a light-source capsule mounted within said outer envelope, said light-source capsule having an operating wattage which is equal to or greater than one hundred and seventy-five watts, said light-source capsule being subject to burst on rare occasions;

(c) means for shielding said outer envelope by absorbing and dissipating a portion of the energy of a burst of said light-source capsule, said shielding means including a light-transmissive shield mounted within said outer envelope, said shield substantially surrounding said light-source capsule; and (d) means within said lamp for providing electrical power from an external source to said light-source capsule and for mechanically completing said lamp;

(e) whereby said outer envelope will remain intact in the event of a burst of said light-source capsule and the performance of said lamp is improved.

2. A lamp as described in claim 1 wherein said lamp includes means for reinforcing said shield such that the ability of said shield to remain intact after a burst of said light-source capsule is improved in comparison to the ability of said shield unaided by said reinforcing means.

3. A lamp as described in claim 1 wherein said lamp includes means for reinforcing said outer envelope such that said outer envelope has the ability to contain a burst of a light-source capsule having a higher operating wattage than a light-source capsule capable of being contained by said outer envelope unaided by said outer-envelope reinforcing means.

4. A lamp as described in claim 1 wherein said light-source capsule includes a body and at least one end, and said capsule body has a maximum wall thickness less than one millimeter.

5. A lamp as described in claim 1 wherein said shield comprises a mesh surrounding said light-source capsule.

6. A lamp as described in claim 1 wherein said shield comprises a surface surrounding said light-source capsule, said surface being subject to being shattered by a burst of said light-source capsule.

7. A lamp as described in claim 6 wherein said surface of said shield has a maximum wall thickness of two millimeters.

8. A lamp as described in claim 1 wherein said outer envelope has a minimum wall thickness sufficient to insure that said outer envelope will contain all shards of said light-source capsule and said shield in the event of a burst of said light-source capsule.

9. A lamp as described in claim 1 wherein said shield is heat-reflecting, and the luminous efficacy, color-rendering ability, and life of said lamp are substantially improved in comparison with the same lamp without the presence of said shield.

10. A lamp as described in claim 9 wherein said light-source capsule includes a central body having a maximum cross-sectional outer radius of approximately 11 millimeters.

11. A lamp as described in claim 10 wherein said shield includes a central body substantially surrounding said central body of said light-source capsule, and said central body of said shield has a maximum cross-sectional inner radius of approximately 17.5 millimeters.

12. A lamp as described in claim 1 wherein said shield comprises a right circular cylinder open at both ends of said cylinder.

13. A lamp as described in claim 12 wherein said light-source capsule is single-ended, and said cylindrical shield laterally surrounds said body and said end of said light-source capsule.

14. A lamp as described in claim 12 wherein said light-source capsule is double-ended, and said cylindrical shield laterally surrounds said body and both of said ends of said light-source capsule.

15. A lamp as described in claim 13 wherein said cylindrical shield has a dome on at least one end of said shield.

16. A lamp as described in claim 14 wherein said cylindrical shield has a dome on at least one end of said shield.

17. A lamp as described in claim 1 wherein said outer envelope is hermetically sealed.

18. A lamp as described in claim 17 wherein a vacuum is contained within said outer envelope.

19. A lamp as described in claim 17 wherein the atmosphere within said outer envelope includes nitrogen.

20. A lamp as described in claim 19 wherein the pressure within said outer envelope is approximately one atmosphere when said lamp is in steady state operation.

21. A lamp as described in claim 1 wherein said light-source capsule is a tungsten-halogen incandescent capsule.

22. A lamp as described in claim 1 wherein said light-source capsule is an arc discharge tube.

23. A lamp as described in claim 22 wherein said arc discharge tube is a metal-halide arc discharge tube.

24. A lamp as described in claim 23 wherein said lamp has an operational wattage of approximately four hundred watts.

25. A lamp as described in claim 6 wherein said shield has a wall thickness sufficient to insure that said outer envelope will contain all shards of said light-source capsule and said shield in the event of a burst of said light-source capsule.

26. A lamp as described in claim 1 wherein said shield is formed from quartz glass.

27. A lamp as described in claim 1 wherein said shield is formed from vycor.

28. A lamp as described in claim 1 wherein said light-source capsule includes a central body having a maximum wall thickness, x; said shield includes a central body substantially surrounding said central body of said light-source capsule, said central body of said shield having a minimum wall thickness, y; said outer envelope includes a body and a neck, said body of said outer envelope substantially enclosing said light-source capsule and said shield, said body of said outer envelope having a minimum wall thickness, z; and the ratio y/x falls within the range of approximately two to one.

29. A lamp as described in claim 1 wherein said outer envelope is formed from tempered glass.

30. A lamp as described in claim 1 wherein said shield is formed from tempered glass.

31. A lamp as described in claim 1 wherein said light-source capsule includes a central body having a maximum cross-sectional outer radius, u; said shield is substantially a right circular cylinder with inner radius, v; said outer envelope includes a bulbous central portion laterally surrounding said light-source capsule and said shield, said bulbous portion having a maximum inner radius, w; and the ratio v/u falls within the range of approximately 0.5 to 0.7.

32. A lamp as described in claim 31 wherein the ratio v/u is approximately 0.63.

33. A lamp as described in claim 1 wherein said lamp is a reflector-type lamp.

34. A lamp as described in claim 1 wherein said lamp is single-ended.

35. A lamp as described in claim 34 wherein said envelope has a mogul type base mounted on said end of said lamp.

36. A lamp as described in claim 34 wherein said lamp has a standard Edison-type base mounted on said end of said lamp.

37. A lamp as described in claim 1 wherein said lamp has a central axis, and said lamp is designed to be operated with said axis substantially vertical.

38. A lamp as described in claim 37 wherein said lamp is single-ended having a base mounted on said end of said lamp, and said lamp is designed to be operated in the base-up position.

39. A lamp as described in claim 33 said reflector-type lamp includes a parabolic aluminized reflector.

40. A lamp as described in claim 1 wherein said light-source capsule includes a central body and at least one end, and said capsule has a heat-reflecting coating disposed on at least one end of said capsule.

41. A lamp as described in claim 40 wherein said heat-reflecting coating is zirconium oxide.

42. A lamp as described in claim 2 wherein said shield reinforcing means is mounted on said shield.

43. A lamp as described in claim 33 wherein said lamp includes an arc discharge light-source capsule.

44. A lamp as described in claim 33 wherein said lamp includes a tungsten-halogen light-source capsule.

45. A lamp as described in claim 42 wherein said shield includes an exterior surface substantially facing said outer envelope, and said shield reinforcing means includes a wire mesh mounted on said outside surface of said shield.

46. A lamp as described in claim 45 wherein said wire mesh is formed from stainless steel wire.

47. A lamp as described in claim 46 wherein said wire mesh is loosely woven.

48. A lamp as described in claim 3 wherein said outer envelope includes an inside surface substantially facing said light-source capsule and said shield and an outside surface substantially facing the exterior of said lamp, and said outer-envelope reinforcing means includes a coating disposed on one of said surfaces of said outer envelope.

49. A lamp as described in claim 48 wherein said coating includes a polymer.

50. A lamp as described in claim 1 wherein said lamp includes an electrically conductive frame within said outer envelope, and said light-source capsule and said shield are mounted on said frame.

51. A lamp as described in claim 1 wherein said lamp includes an electrically conductive frame within said outer envelope, said frame being electrically isolated from the electrical circuit of said lamp.

52. A lamp as described in claim 51 wherein said frame is formed from stiff metal wire.

* * * * *